US005977043A

United States Patent [19]

Howie

[11] Patent Number: 5,977,043

[45] Date of Patent: Nov. 2, 1999

[54] CLEANING COMPOUND AND METHOD OF USE

[76] Inventor: Jane B. Howie, 3316 Koenig, Cincinnati, Ohio 45211

[21] Appl. No.: 09/062,000

[22] Filed: Apr. 17, 1998

Related U.S. Application Data

[60] Provisional application No. 60/044,077, Apr. 17, 1997.

[51] Int. Cl.[6] ..... C11D 14/02; C11D 7/10; C11D 7/60; C11D 17/06

[52] U.S. Cl. ..... 510/268; 510/218; 510/236; 510/241; 510/256

[58] Field of Search ..... 510/268, 236, 510/245, 241, 218, 465, 108, 256

[56] References Cited

U.S. PATENT DOCUMENTS

| | | | |
|---|---|---|---|
| 174,355 | 3/1876 | Cross | 510/268 |
| 692,358 | 2/1902 | Roose-Jones | 510/268 |
| 705,956 | 7/1902 | Oberwalder | 510/268 |
| 1,456,151 | 5/1923 | Ruddell | 510/268 |
| 2,020,228 | 11/1935 | Ashton | 510/268 |
| 2,191,199 | 2/1940 | Hall | 510/268 |
| 3,888,783 | 6/1975 | Rodzewich | 252/135 |
| 3,927,970 | 12/1975 | Ciko et al. | 8/137 |
| 3,944,506 | 3/1976 | Hramchenko et al. | 252/526 |
| 3,975,215 | 8/1976 | Rodzewich | 148/6.17 |
| 4,021,360 | 5/1977 | McLauglin et al. | 252/99 |
| 4,033,894 | 7/1977 | McLaughlin et al. | 252/99 |
| 4,048,123 | 9/1977 | Hramchenko et al. | 252/545 |
| 4,092,258 | 5/1978 | McLaughlin et al. | 252/99 |
| 4,127,496 | 11/1978 | Stokes | 252/95 |
| 4,237,024 | 12/1980 | Fedechko | 252/99 |
| 4,395,347 | 7/1983 | McLaughlin et al. | 252/139 |

*Primary Examiner*—Mark Kopec
*Assistant Examiner*—John M Petruncio
*Attorney, Agent, or Firm*—Carol D. Titus; James J. Leary

[57] ABSTRACT

A cleaning compound formed of a mixture of hydrated sodium borate and sodium chloride. If desired, an aroma such as lemon may be added to provide a pleasant scent during the use of the product. The cleaning compound is sprinkled over moist or damp residual food material in a pot or on another surface to be cleaned. The user rubs the cleaning compound around the pot forming small balls. The small balls are a combination of the residual food material and the cleaning compound, which is then disposed of by garbage disposal, ordinary drain, trash can, etc.

16 Claims, No Drawings

CLEANING COMPOUND AND METHOD OF USE

CROSS REFERENCE TO OTHER APPLICATIONS

This application claims the benefit of U.S. Provisional Patent Application Ser. No. 60/044,077 filed Apr. 17, 1997.

FIELD OF INVENTION

The present invention relates to a cleaning compound and a method for its use. More particularly, it relates to a cleaning compound which may be used in cleaning food residue from dishes, pots and pans, the compound being predominantly formed from a combination of hydrated sodium borate and sodium chloride.

BACKGROUND OF THE INVENTION

Typically, when a user wishes to clean an object of dirt or debris, soap and water is applied to the surface of the object to be cleaned. Then, the object is rubbed. The soap decreases the surface tension of the water, allowing the water to more quickly penetrate, pick up, and carry away the dirt or debris being removed. Soap is generally an organic substance which is formed of a fat or oil and an alkali.

Sodium borate, commonly referred to as borax, has been added to soap to enhance the cleaning effectiveness of the soap. Literature suggests that the addition of borax adds in the cleaning process by conditioning the water and thereby allowing the soap to work more effectively.

Borax alone has also been advertised as a cleanser which may be used on delicate surfaces such as porcelain and aluminum. The user is directed to sprinkle the borax on the surface, then rub with a damp dishcloth.

However, none of the existing cleaning materials successfully and easily remove sticky residue. Therefore, a substance which would remove residue on dishes and other surface would be of great benefit to cleaning technology.

SUMMARY OF THE INVENTION

In keeping with the foregoing discussion, the objective of the present invention is to provide a substance which may be safely and effectively used to clean food residue from dishes, pots and pans. Preferably, the substance is capable of cleaning surfaces in a nonmarring fashion, so that the substance may be used on teflon and other sensitive surfaces without concern over damaging the pot, pan, utensil, etc.

In keeping with these objectives, the present invention takes the form of a cleaning compound which is a mixture of hydrated sodium borate and sodium chloride. If desired, an aroma such as lemon may be added to provide a pleasant scent during the use of the product. Optimally, the cleaning compound is used in the following fashion. The cleaning compound is sprinkled over moist or damp residual food material in a pot or on another surface to be cleaned. The user rubs the cleaning compound around the pot forming small balls. The small balls are a combination of the residual food material and the cleaning compound, which is then disposed of by garbage disposal, ordinary drain, trash can, etc. Other objects and advantages of the invention will no doubt occur to those skilled in the art upon reading and understanding the following detailed description along with the accompanying drawings.

DETAILED DESCRIPTION OF THE INVENTION

The cleaning compound is predominantly a combination of hydrated sodium borate and a salt. Although any hydration level may be used, two typical hydration levels of hydrated sodium borate are $Na_2B_4O_7 \cdot 5H_2O$ and $Na_2B_4O_7 \cdot 10H_2O$. The 10 mole hydration material is typically 8/60 coarseness. The 5 mole hydration level is slightly larger. It is believed that the 5 mole hydration level is currently sold as 20 MULE TEAM® Borax by The Dial Corporation of Scottsdale, Ariz.

Currently, the salt used is sodium chloride, NaCl, having a coarseness of plus 30 mesh with 40 mesh and 50 mesh being the highest percentage in the mixture of the ranges in a bell shaped curve distribution with a minus 100 mesh, which is dust, being the finest and equal in percentage of weight to the weight of the plus 30 mesh which is the largest granule. Currently used are cubic, crystals of this size combination which is currently sold as table salt. Variations of the size mixture are possible. Other salts may also be used. The salts are preferably granular and nontoxic, such as potassium chloride, calcium chloride, sodium sulfate, calcium carbonate, potassium acid phosphate, calcium fluoride, and sodium acetate.

These two granular materials are mixed together, thereby forming a granular mixture. If desired, a lemon or other aroma may be added to the mixture to provide a pleasant smell while the compound is being used. Optimally, the aroma would be added in the form of a scented powder; however, the aroma could be added into one or both of the substances during manufacture of the substance or by some other means. Currently, the following are considered to be the effective ranges of the compound:

| | Sodium Borate % by Volume | Salt % by Volume | Aroma % by Volume |
|---|---|---|---|
| Usable Range | 1–80 | 19–98 | 1 |
| Good Range | 10–25 | 74–89 | 1 |
| Best Range | 15–20 | 79–84 | 1 |

If aroma is not used, the ranges are:

| | Sodium Borate % by Volume | Salt % by Volume |
|---|---|---|
| Usable Range | 1–80 | 20–99 |
| Good Range | 10–25 | 75–90 |
| Best Range | 15–20 | 80–85 |

The Usable Range gives a wide range of mixtures which have the properties of the present invention in that they provide substantially increased cleaning effectiveness over either substance by itself. The Good Range provides a narrower range of mixtures which are more effective. In order to achieve the fastest, easiest and most efficient cleaning, the Best Range should be used. This allows the user to use the least amount of the product while still effectively cleaning the desired surface.

OPERATIONAL DESCRIPTION

When used to clean residual food material from a freshly used container, the following is consider the best method of use. Optimally, the container should be cool and any overly large deposits should be scraped off. For an average sized pot or pan (e.g. a 1–2 quart saucepan, a 10–13 inch frying pan, a 9×9 inch baking pan, etc.) 1–2 teaspoons of the cleaning compound is sprinkled over the interior surface of the dish. Another factor which may be used to determine the amount of cleaning compound to use is the amount and consistency of the residue to be removed from the dish. If there is a significant amount of residue and/or the residue is sludgy, more of the cleaning compound should be used. If there is little residue, less compound is needed. The cleaning compound is then rub around and along the surface with a dry paper towel, sponge, dish cloth, etc. This action gently abrades the food material, breaking the residual food down into small granular pieces. These food particles are picked up by the cleaning compound. After approximately one minute, the cleaning compound and residual food begin to form balls.

Once the residual food matter has been substantially or completely cleaned from the surface of the dish, the mixture of the cleaning compound and the food material have combined to form small balls. These small balls or dregs may be discarded in a number of ways, including down a garbage disposal, rinsed down a standard drain, wiped off with a paper towel and discarded into a waste basket, etc. Since the dregs are only slightly moist, the user does not need to worry about them oozing out of a garbage bag. If further residue is present after the balls have been discarded, the process may be repeated.

When used with a dish which is no longer fresh, i.e. a dish which has dried residual food stuck to it, the following is considered the best method of use. Place water in the dish and let stand for approximately 10–15 minutes. Then, pour out any standing water in the dish. The dish may be cleaned immediately or the dish may stand to allow some of the excess moisture to evaporate. However, the user should note that if the dish is too moist, an increased amount of the cleaning compound may be needed to clean the dish, since an increased amount of the compound will be dissolved by the excess water. To clean the dish from this point, the user would follow the directions for a fresh or recently used dish as indicated above.

The cleaning compound is particularly useful when trying to clean sticky or gooey materials, such as barbecue sauce, macaroni and cheese, grease, bread dough, other protein and fat residues, etc. These materials are quickly and easily picked up by the cleaning compound making removal of these residual materials easy and effective.

Another optimal use of the present invention is to clean teflon cooking surfaces. The cleaning compound can safely and harmlessly be used on teflon without worry over marring or damaging the fragile surface.

There are a couple of theories which have been developed to explain the synergistic behavior of the present invention. First, one or both of the substance in the compound may act as the nucleus for a ball of residual food material. The food material adheres slightly to the substance making a slightly larger ball. Each particle of food which sticks to the ball makes the ball slightly larger still. This idea is a similar to the explanation of how snowflakes or raindrops are formed on a nucleus of a dust particle.

A second theory suggests that there is a chemical response, or even a reaction, between the food material and one or both of the substances in the compound. The compound may act as a catalyst promoting the adherence of the food material to the granular particles of the compound and into balls of residual food. For example, the cleaning compound may break down the protein molecules and bond to them forming the balls.

Ultimately, it may be a combination of these two actions which creates the synergistic outcome of the present invention. One of the substances of the compound may act as in the first theory, and the other substance functions as indicated in the second theory. However, these ideas are not meant as a concrete explanation of the behavior of the present invention. Other explanations may be developed which may more accurately explain why the results of the present invention occur.

Although the examples given include many specificities, they are intended as illustrative of only one possible embodiment of the invention. Other embodiments and modifications will, no doubt, occur to those skilled in the art. For example other additives could be added to the cleaning compound, such as a colorant, a denaturant, etc. Also, the example given has described the process as removing food material from a dish, pot or pan; however, the present invention may also be used with other substances and other vessels, utensils, etc. Thus, the examples given should only be interpreted as illustrations of some of the preferred embodiments of the invention, and the full scope of the invention should be determined by the appended claims and their legal equivalents.

I claim:

1. A cleaning compound consisting of:

(a) hydrated sodium borate, from 10–25 percent by volume, and (b) sodium chloride, from 75–90 percent by volume.

2. The cleaning compound of claim 1 wherein said salt has a crystalline structure.

3. The cleaning compound of claim 1 wherein said sodium borate forms between 15 and 20 percent by volume of said cleaning compound.

4. The cleaning compound of claim 1 wherein said salt forms between 80 and 85 percent by volume of said cleaning compound.

5. The cleaning compound of claim 1 wherein said sodium borate is in a granular form.

6. The cleaning compound of claim 1 wherein said salt is granular and nontoxic.

7. A cleaning compound consisting of:

(a) hydrated sodium borate, from 10–25 percent by volume, (b) sodium chloride, from 74–89 percent by volume, and (c) aroma, approximately 1 percent by volume.

8. The cleaning compound of claim 7 wherein said hydrated sodium borate forms between 15 and 20 percent by volume of said cleaning compound and said sodium chloride forms between 79 and 84 percent by volume of said cleaning compound.

9. A method for cleaning residue from a surface of an object, comprising the steps of:

(a) sprinkling a compound formed of sodium borate and sodium chloride onto the surface;

(b) rubbing said compound on the surface of the object;

(c) continuing to rub said compound on the surface until said compound and the residue form balls; and (d) discarding the balls.

10. The method of claim 9 further comprising the steps of:

(e) placing water on the surface of the object;

(f) letting the water stand on the surface of the object for a period of time, thereby softening the residue:

(g) pouring off any standing water on the surface of the object.

11. The method of claim 9 further comprising the step of:

(e) repeating steps (a) through (d) to remove additional residue.

12. The cleaning compound of claim 7 wherein said hydrated sodium borate and said sodium chloride are granular and said aroma is powdered.

13. The method of claim 10 wherein said period of time is at least approximately 10 minutes.

14. The method of claim 9 wherein 1–2 teaspoons of said compound is used to clean a dish.

15. The method of claim 9 wherein said compound is used to clean food residue from a dish.

16. The method of claim 15 wherein said food residue is a gooey material.

* * * * *